US006669321B2

(12) United States Patent
Yoshida

(10) Patent No.: US 6,669,321 B2
(45) **Date of Patent: *Dec. 30, 2003**

(54) CORRECTING VARIATIONS IN INK DISCHARGE VELOCITY IN A PRINTER BY PRINTING A TEST PATTERN AND ADJUSTING A PRINTING POSITION SHIFT

(75) Inventor: Hajime Yoshida, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/219,753

(22) Filed: Dec. 23, 1998

(65) Prior Publication Data

US 2002/0030708 A1 Mar. 14, 2002

(30) Foreign Application Priority Data

Dec. 24, 1997 (JP) ..... 9-355003

(51) Int. Cl.[7] ..... B41J 29/393
(52) U.S. Cl. ..... 347/19
(58) Field of Search ..... 347/19, 37, 8; 400/74

(56) References Cited

U.S. PATENT DOCUMENTS

| | | | | | |
|---|---|---|---|---|---|
| 4,158,204 | A | * | 6/1979 | Kuhn et al. | 347/19 |
| 4,313,124 | A | | 1/1982 | Hara | 346/140 R |
| 4,345,262 | A | | 8/1982 | Shirato et al. | 346/140 R |
| 4,459,600 | A | | 7/1984 | Sato et al. | 346/140 R |
| 4,463,359 | A | | 7/1984 | Ayata et al. | 346/1.1 |
| 4,558,333 | A | | 12/1985 | Sugitani et al. | 346/140 R |
| 4,723,129 | A | | 2/1988 | Endo et al. | 346/1.1 |
| 4,740,796 | A | | 4/1988 | Endo et al. | 346/1.1 |
| 4,789,874 | A | * | 12/1988 | Majette et al. | 347/37 |
| 4,818,129 | A | * | 4/1989 | Tanuma et al. | 400/323 |
| 5,442,383 | A | * | 8/1995 | Fuse | 347/19 |
| 5,448,269 | A | * | 9/1995 | Beauchamp et al. | 347/19 |
| 5,502,468 | A | * | 3/1996 | Knierim | 347/19 |
| 5,592,202 | A | * | 1/1997 | Erickson | 347/37 |

FOREIGN PATENT DOCUMENTS

| | | | |
|---|---|---|---|
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |

* cited by examiner

*Primary Examiner*—Stephen D. Meier
*Assistant Examiner*—Julian D. Huffman
(74) *Attorney, Agent, or Firm*—Fitzpatrick, Cella, Harper & Scinto

(57) ABSTRACT

A correction method for determining a correction amount for correcting a printing position shift based on ink discharge velocity in a printer. The printer prints a plurality of identical adjustment patterns while changing the printhead scanning speed by a predetermined amount. The plurality of printed patterns are visually compared, a pattern with the highest quality is selected, and the selection result is designated to the printer through a host. In accordance with the designation, the printer stores a velocity of discharging an ink from the printhead, which is necessary for printing the selected pattern, in a non-volatile memory (NVRAM). After this, the correction amount for correcting the printing position shift is calculated on the basis of the stored ink discharge velocity, and printing is performed while correcting the printing potion shift using the correction amount.

15 Claims, 10 Drawing Sheets

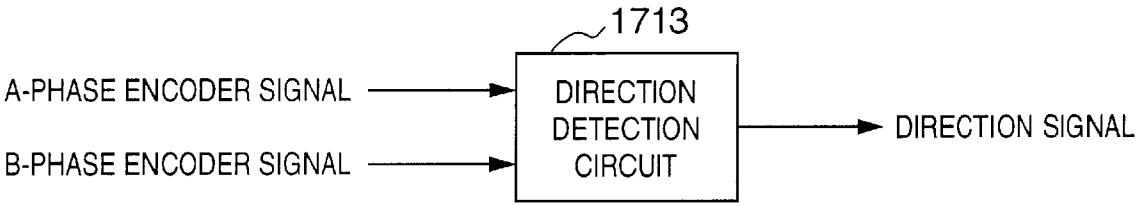
FIG. 4A
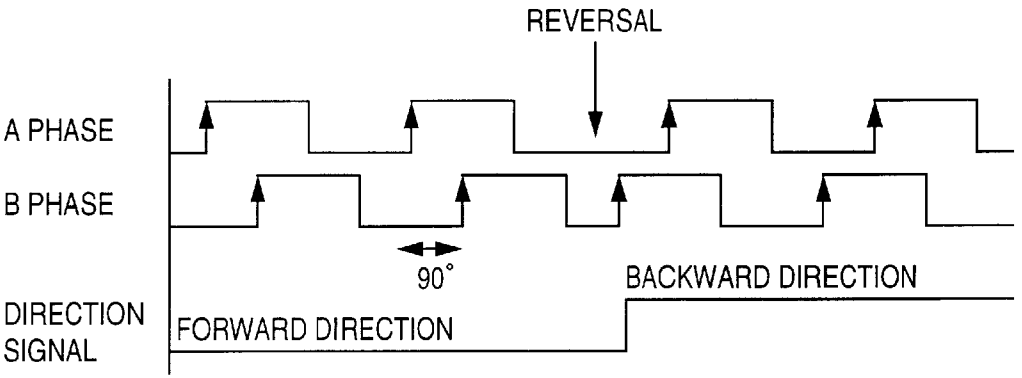
FIG. 4B
WHEN { A PHASE ( B PHASE ↑ ) = 1 ∪ A PHASE ( B PHASE ↓ ) = 0 ∪ B PHASE ( A PHASE ↑ ) = 0 ∪ B PHASE ( A PHASE ↓ ) = 1 }, FORWARD DIRECTION
WHEN { A PHASE ( B PHASE ↑ ) = 0 ∪ A PHASE ( B PHASE ↓ ) = 1 ∪ B PHASE ( A PHASE ↑ ) = 1 ∪ B PHASE ( A PHASE ↓ ) = 0 }, BACKWARD DIRECTION
NOTE :
" A PHASE ( B PHASE ↑ ) " MEANS " VALUE OF A PHASE AT RISE OF B-PHASE SIGNAL ";
" A PHASE ( B PHASE ↓ ) " MEANS " VALUE OF A PHASE AT FALL OF B-PHASE SIGNAL ";
AND " ∪ " MEANS " OR ".
FIG. 4C

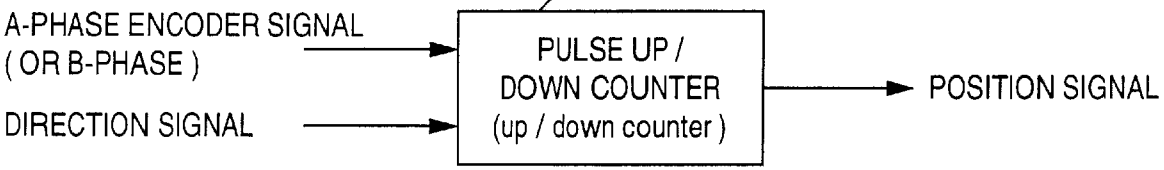
FIG. 5A
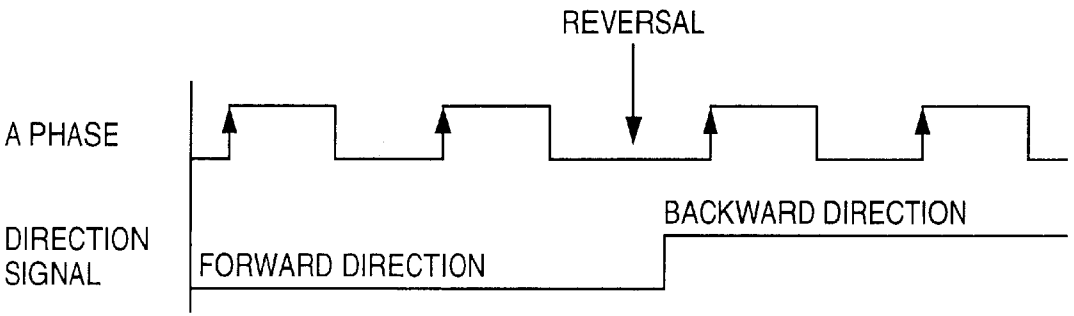
FIG. 5B
WHEN DIRECTION SIGNAL ( ENCODER SIGNAL ↑ ) = 0, ADDITION IS PERFORMED
WHEN DIRECTION SIGNAL ( ENCODER SIGNAL ↑ ) = 1, SUBTRACTION IS PERFORMED
NOTE :
" DIRECTION SIGNAL ( ENCODER SIGNAL ↑ ) " MEANS
" VALUE OF DIRECTION SIGNAL AT RISE OF ENCODER SIGNAL ".
FIG. 5C

CORRECTING VARIATIONS IN INK DISCHARGE VELOCITY IN A PRINTER BY PRINTING A TEST PATTERN AND ADJUSTING A PRINTING POSITION SHIFT

BACKGROUND OF THE INVENTION

The present invention relates to a correction method and printing apparatus and, more particularly, to a correction method and printing apparatus for performing printing using a printhead based on an inkjet printing method.

In a printing apparatus for performing printing by discharging an ink to printing paper while serially scanning a printhead according to an inkjet printing method, the position of the printhead at the start of discharge and the position at which the ink reaches the printing paper do not match generally because the ink is discharged while moving the printhead. This will be called a printing position shift herein.

If printing is performed in only one direction, the printing position shift basically poses no problems. However, in reciprocal scanning of the printhead, i.e., when printing is performed in two directions for forward scanning and backward scanning, certain control is necessary. Otherwise, the printing positions in both directions never match, resulting in poor print image quality.

For an inkjet printer, not only an increase in printing speed but also an improvement in print quality is required. It is therefore important to print a high-quality image even in printing by moving the printhead in two direction.

In actual printing, to correct the printing position shift in the two directions, the position of the printhead at the start of discharge is shifted in advance with respect to the printhead moving direction, thereby reducing the printing position shift.

The one-direction (printhead scanning direction) component ($\Delta X$) of a printing position shift in bidirectional printing is determined by (1) ink discharge velocity ($V_{DROP}$), (2) ink discharge angle ($\theta$), (3) distance (L) between the printhead and the printing medium surface, and (4) printhead moving speed ($V_{CR}$), as shown in FIG. 10, and calculated by equation (1):

$$\Delta X=\{L/(V_{DROP}\times\sin\theta)\}\times V_{CR} \quad (1)$$

Referring to FIG. 10, the forward head direction means a direction in which the printhead leaves its home position, and the backward head direction means a direction in which the printhead approaches its home position.

These factors generally have variations of individual devices and therefore cannot always have designed deviations. The deviation of the printing position shift in two directions due to the variations of the individual devices must be compensated for. An adjustment operation of compensating for the individual difference will be called bidirectional registration adjustment.

These variations occur due to mechanical factors, mechanical control factors, characteristic factors of printheads, and the like. For an actual device, (1) adjustment considering mechanical and control factors is performed in the manufacturing process at factories, and (2) adjustment considering the printhead characteristic factors is performed by end users.

Conventional bidirectional registration adjustment is realized by simply changing the printing position shift amount.

More specifically, adjustment is performed in accordance with the following procedures.

(1) For each variation factor, a printing position shift amount (default correction value) is calculated from the design value on the basis of equation (1) and stored in a ROM in advance.

(2) In the print head manufacturing process at a factory, a deviation from the default correction value is stored in a non-volatile memory (NVRAM) as a device variation and used as a factory correction value.

(3) Finally, an end user stores a deviation from the default correction value+factory correction value in an NVRAM as a printhead variation and used as a user correction value.

(4) After this, printing is performed by using the default correction value+factory correction value+user correction value as a printing position shift amount.

In (2) and (3), (a) first, adjustment patterns obtained by changing the shift amount at a predetermined interval are printed on a printing medium, (b) the printed adjustment patterns are visually compared and checked, and an adjustment value for obtaining a printing result which is supposed to be the best pattern is selected, and (c) finally, the selected adjustment value is stored in the NVRAM, thereby obtaining the correction value.

However, the conventional correction method assumes that the ink discharge velocity does not largely vary. That is, the variation in ink discharge velocity is not included in the factors taken into consideration for correction. For this reason, when the ink discharge velocity largely varies, the shift cannot be satisfactorily corrected.

SUMMARY OF THE INVENTION

Accordingly, it is an object of the present invention to provide a correction method and printing apparatus capable of performing satisfactory correction even though the ink discharge velocity varies due to various factors for changing the characteristics of a printhead, including a change in printhead over time and exchange of the printhead.

According to one aspect of the present invention, the foregoing object is attained by providing a correction method of correcting a printing position shift when printing on a print medium is performed by discharging ink from a printhead while reciprocally scanning the printhead, comprising: a test printing step of test-printing a plurality of patterns while changing printhead scanning speed; a selection step of selecting one of the plurality of printed patterns; and a calculation step of calculating a correction amount for correcting the printing position shift, based on the selected pattern.

Note that an operator makes a selection in the selection step.

It is preferable that the calculation step calculates the correction amount, based on information on an ink discharge velocity from the printhead used for test-printing the selected pattern. Furthermore, it is preferable that the above-described method further comprises a storage step of storing the information into a memory such as a non-volatile memory after performing the selection step, and wherein the calculation step calculates the correction amount, based on the information stored in the memory.

The printing position shift is a shift ($\Delta X$) with respect to a scanning direction of the printhead. The calculation step calculates the correction amount using an equation $\Delta X=\{L/(V_{DROP}\times\sin\theta)\}\times V_{CR}$, where $V_{DROP}$ is the ink discharge velocity, $V_{CR}$ is the printhead scanning speed, L is a distance between the printhead and the printing medium, and $\theta$ is an ink discharge angle with respect to the printing medium.

The test printing step preferably comprises tentatively performing printing while changing the printhead scanning speed by a predetermined amount.

According to another aspect of the present invention, the foregoing object is attained by providing a printing apparatus, having scanning means for reciprocally scanning a printhead, for performing printing on a print medium by discharging ink from the printhead while scanning the printhead by the scanning means, comprising: test pattern printing means for test-printing a plurality of patterns while changing a printhead scanning speed; selection means for selecting one of the plurality of patterns; calculation means for calculating a correction amount for correcting a printing position shift when printing on a print medium is performed by discharging ink from the printhead, based on a pattern selected from the plurality of patterns by the selection means; and printing means for performing actual printing while performing correction based on the correction amount calculated by the calculation means.

Note that the calculation means may calculate the correction amount, based on an ink discharge velocity from the printhead corresponding to a printhead scanning speed used for test-printing the pattern selected by the selection means.

It is preferable that the apparatus further comprises memory means for storing information on the ink discharge velocity, wherein the calculation means calculates the correction amount, based on the information stored by the memory means.

It is also preferable that the apparatus further comprises a scanning speed detection means for detecting a scanning speed during reciprocal scanning of the printhead, wherein the calculation means calculates the correction amount, based on the scanning speed detected by the scanning speed detection means and an ink discharge velocity from the printhead corresponding to a printhead scanning speed used for test-printing the pattern selected by the selection means.

The apparatus preferably further comprises a position detection means for detecting a position of the printhead during the reciprocal scanning.

The scanning speed detection means and the position detection means respectively detect the scanning speed and position of the printhead, based on an encoder signal obtained from a linear encoder placed along a scanning direction of the scanning means. The linear encoder can be an optical encoder or a magnetic encoder.

The printhead preferably comprises an inkjet printhead for discharging the ink to perform printing. The printhead preferably comprises an electrothermal transducer for generating a thermal energy to be applied to the ink, thereby discharging the ink using the thermal energy.

The memory means comprises a non-volatile memory such as an EEPROM.

In accordance with the present invention as described above, a plurality of patterns are test-printed while changing the printhead scanning speed, one of the plurality of printed patterns is selected, the correction amount for correcting the printing position shift is calculated, based on the selected pattern.

The invention is particularly advantageous since high-quality printing can be performed while correcting the printing shift even though the ink discharge velocity from the printhead changes.

With this arrangement, even though the quality of a manufactured printhead varies during the printhead manufacturing process, satisfactory correction can be performed to maintain high image quality. This contributes to increasing the yield, so improvement of productivity or reduction of production cost can be achieved.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 4A, 4B, and 4C are schematic diagrams for explaining the operation of a direction detection circuit 1713;

FIGS. 5A, 5B, and 5C are schematic diagrams for explaining the operation of a position detection circuit 1714;

DETAILED DESCRIPTION OF THE PREFERRED EMBODIMENT

Preferred embodiments of the present invention will now be described in detail in accordance with the accompanying drawings.

Brief Description of Apparatus Main Body

Figure 1:
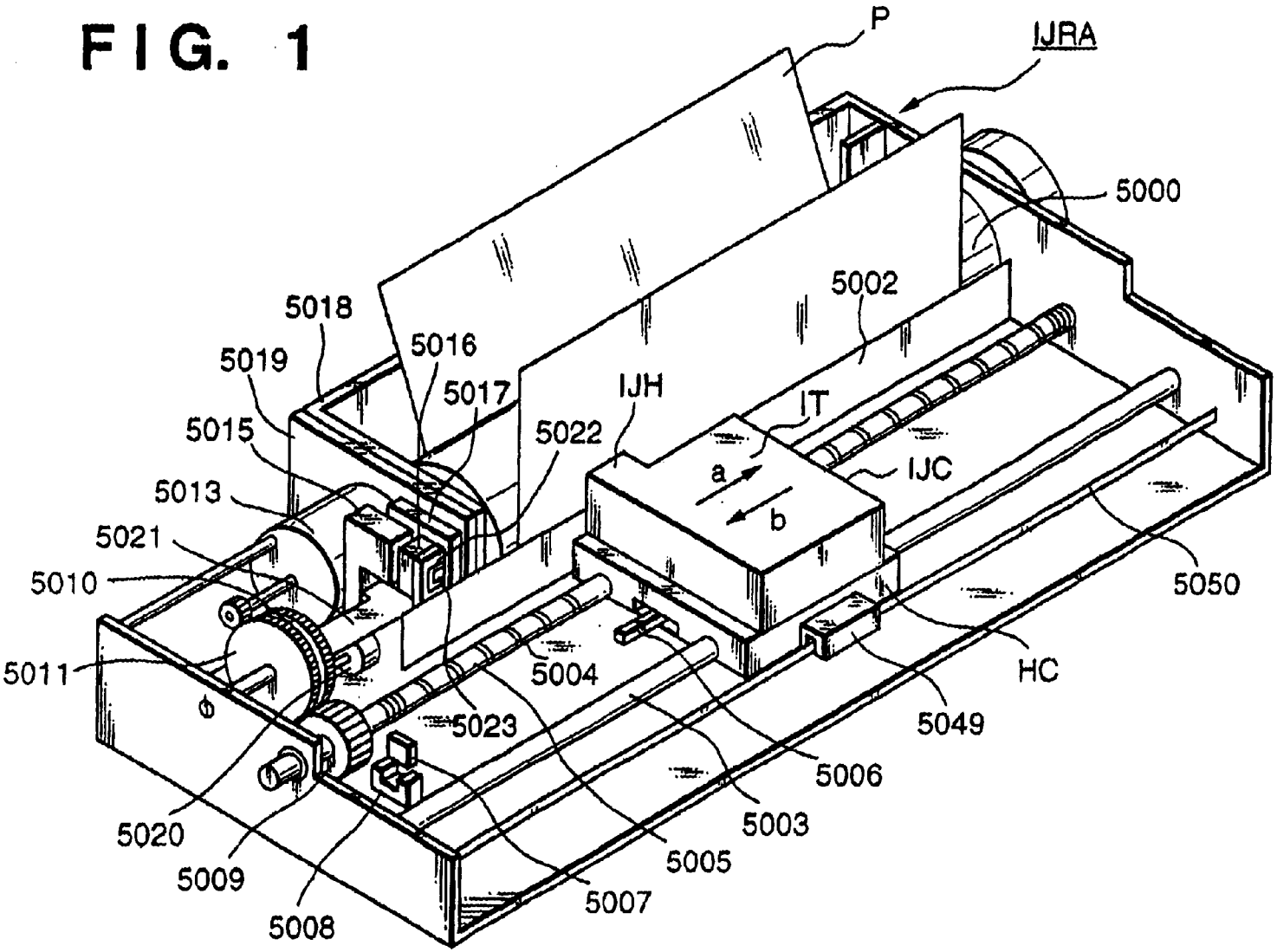
FIG. 1 is a perspective view showing the schematic arrangement of an inkjet printer IJRA, which has a linear encoder, as a typical embodiment of the present invention.

FIG. 1 is a perspective view showing the schematic arrangement of an inkjet printer (hereinafter referred to as a printer) IJRA as a typical embodiment of the present invention. This printer can perform printing by discharging ink in both the forward and backward directions in reciprocal scanning of a printhead.

Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An integrated ink-jet cartridge IJC which incorporates a printing head IJH and an ink tank IT is mounted on the carriage HC. Reference numeral 5002 denotes a sheet pressing plate, which presses a paper sheet P against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a CPA member 5022, which caps the front surface of the printing head IJH; and 5015, a suction device for sucking ink residue through the interior of the cap member. The suction device 5015 performs suction recovery of the printing head via an opening 5023 of the CPA member 5015. Reference numeral 5017 denotes a cleaning blade; 5019, a member which allows the blade to be moveable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

The printer has a linear scale 5050 parallel to a guide rail 5003 and having slits at equal intervals. A carriage HC has an optical encoder 5049 placed across the linear scale 5050. An encoder pulse signal is generated from the optical encoder 5049 as the carriage HC moves.

Figure 2A:
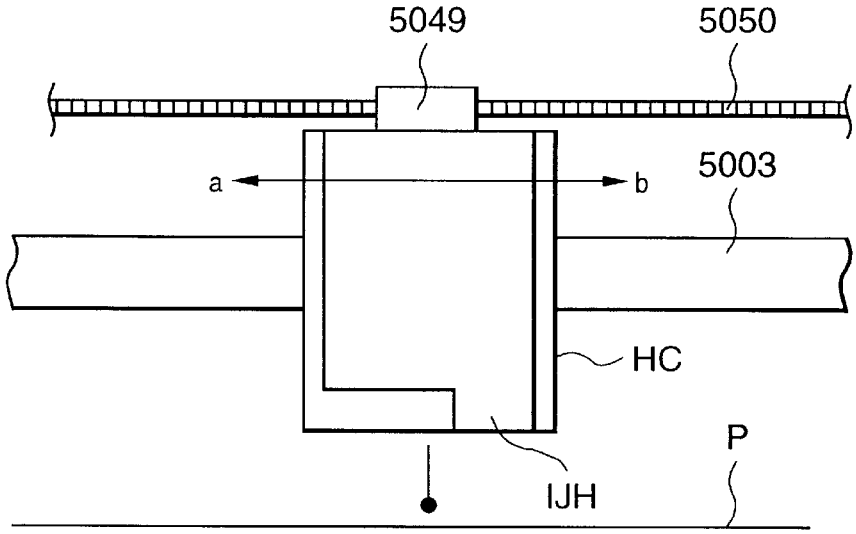
FIGS. 2A and 2B are enlarged views showing the arrangement of the linear encoder in the printer IJRA.
Figure 2B:
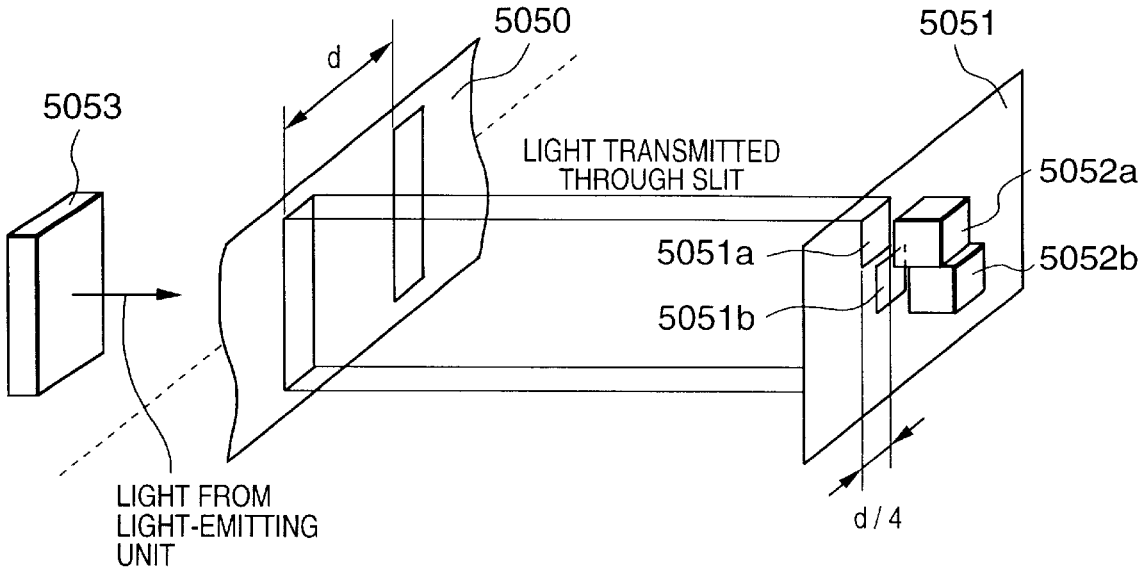

FIGS. 2A and 2B are enlarged views showing the arrangement of a linear encoder in the printer IJRA. FIG. 2A is a plan view of the carriage HC.

As shown in FIG. 2A, the linear scale 5050 having slits is fixed in the printer IJRA. The optical encoder 5049 reciprocally moves relative to a printing medium P and linear scale 5050 along the guide rail 5003 as the carriage HC moves in a direction a (forward direction) or b (backward direction).

The linear encoder used in this embodiment is an optical linear encoder constituted by the linear scale 5050 and optical encoder 5049. More specifically, the optical encoder 5049 comprises a shielding plate 5051 opposing the linear scale 5050 having slits at an interval "d" to shield light, two light-receiving units 5052*a* and 5052*b* behind the shielding plate 5051, and a light-emitting unit 5053 for irradiating the light-receiving units 5052*a* and 5052*b* with light through a slit of the linear scale 5050, as shown in FIG. 2B.

The shielding plate 5051 has two slits 5051*a* and 5051*b* at an interval (d/4), i.e., ¼ the slit interval of the linear scale 5050. The light-receiving units 5052*a* and 5052*b* are arranged behind the two slits 5051*a* and 5051*b* to receive light transmitted through the slits, respectively.

With this arrangement, light transmitted through each of the slits 5051*a* and 5051*b* is received by a corresponding one of the light-receiving units 5052*a* and 5052*b* and converted into an electrical signal to generate an encoder signal. The moving position information of a printhead IJH is obtained on the basis of the encoder signal. The printhead IJH is driven in accordance with the moving position information to discharge ink at a predetermined position of the printing medium P, thereby performing printing.

The output from the light-receiving unit 5052*a* is called an A-phase output, and the output from the light-receiving unit 5052*b* is called a B-phase output. Since the optical encoder 5049 including the light-receiving units 5052*a* and 5052*b* and shielding plate 5051 moves as the carriage HC moves, the output from each light-receiving unit changes in accordance with the overlapping state of the slit of the linear scale 5050 and the slit of the shielding plate 5051. More specifically, when these slits completely overlap, the output from the light-receiving unit is maximized. When these slits do not overlap at all, the output is minimized. In an intermediate state between the two states, the output approximately linearly changes in accordance with the overlapping state of the slits. Therefore, the continuous waveform of the light-receiving output according to movement of the carriage HC is a triangular waveform.

As described above, since the two slits 5051*a* and 5051*b* of the shielding plate 5051 are shifted from each other by (d/4), i.e., ¼ the slit interval of the linear scale 5050 in the moving direction of the carriage HC, the continuous waveform of the A-phase output and that of the B-phase output are shifted in phase by 90°. When the continuous waveforms as triangular waveforms are converted into pulse signals with reference to a predetermined level, A- and B-phase encoder signals having a phase difference of 90° are obtained as pulse signal outputs.

In this embodiment, the optical linear encoder is used. However, a magnetic linear encoder may be used. A magnetic linear encoder has a linear member magnetized at a predetermined interval and a two-phase magnetic detector having a phase shift of 90°. One is fixed on the immovable main body side, and the other is fixed on a movable member such as a carriage.

Description of Control Arrangement

A control arrangement for executing printing control of the above-described apparatus will be described next.

Figure 3:
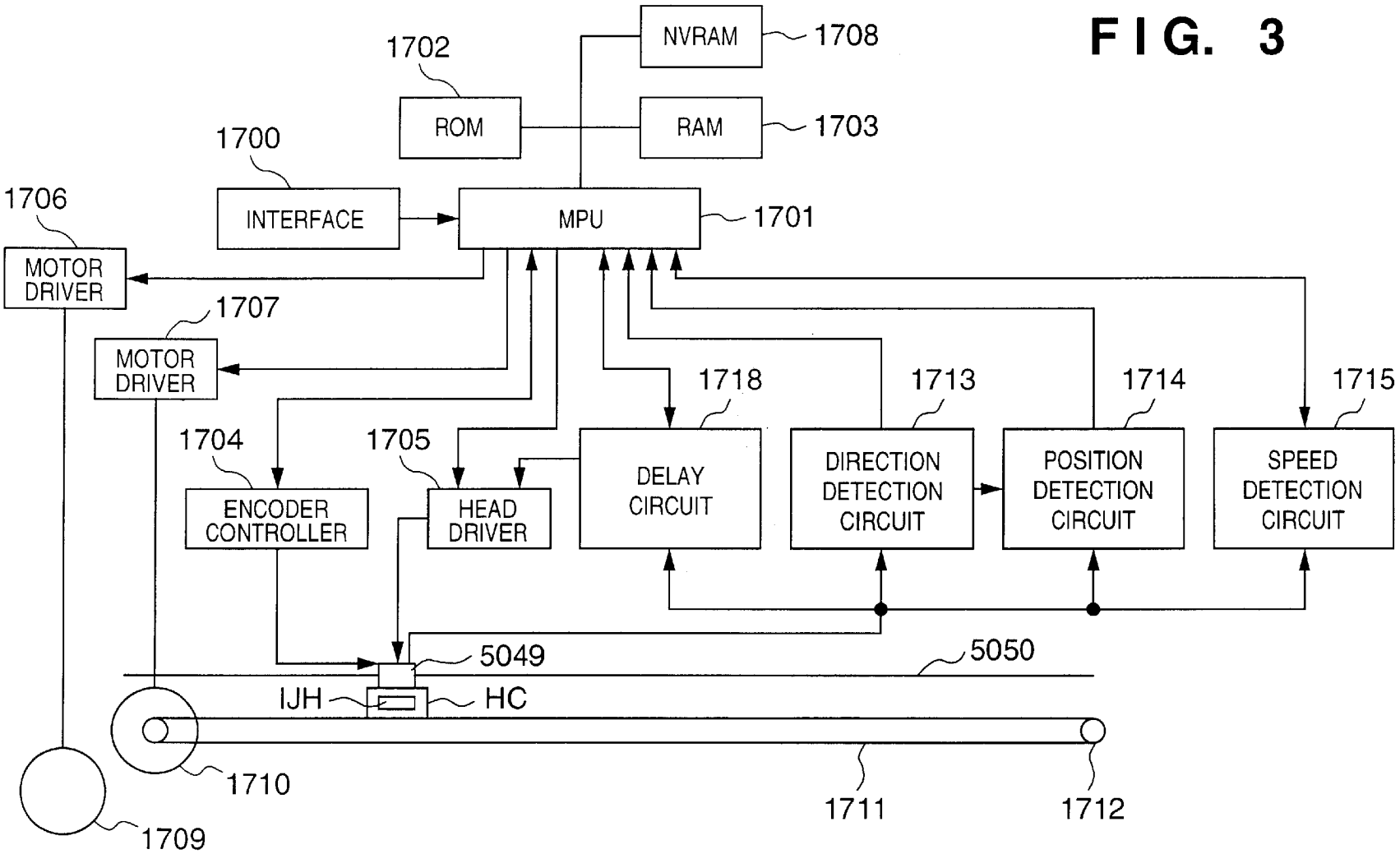
FIG. 3 is a block diagram showing the arrangement of a control circuit of the printer IJRA.

FIG. 3 is a block diagram showing the arrangement of a control circuit of the printer IJRA. Referring to FIG. 3 showing the control circuit, reference numeral 1700 denotes an interface for inputting a print signal; 1701, an MPU; 1702, a ROM storing a control program executed by the MPU 1701; 1703, a DRAM for storing various data (print signal or print data to be supplied to the printhead IJH); 1710, a carrier motor (DC motor) for moving a belt 1711 on which the carriage HC having the printhead IJH is fixed, thereby generating a driving force for moving the printhead IJH; 1709, a conveyance motor for conveying printing paper; 1705, a head driver for moving the printhead IJH; and 1706 and 1707, motor drivers for driving the conveyance motor 1709 and carrier motor 1710, respectively.

Especially, the motor driver 1707 has a forward rotation driving function, a reverse rotation driving function, and a control function of short-circuiting the motor terminal.

Reference numeral 1708 denotes a non-volatile memory (NVRAM) such as an EEPROM for storing correction data; and 1712, a pulley paired with the carrier motor 1710 and used to move the carriage HC.

The operation of the control arrangement will be described. When a print signal is supplied to the interface 1700, the print signal is converted into print data for printing. The motor drivers 1706 and 1707 are driven, and simultaneously, the printhead IJH is driven in accordance with the print data sent to the head driver 1705 to perform printing.

The optical encoder 5049 is driven and controlled by an encoder driver 1704 on the basis of an instruction from the MPU 1701. On the basis of encoder signals obtained from the optical encoder 5049, the encoder driver 1704 generates a print timing signal and transfers it to a direction detection circuit 1713, position detection circuit 1714, speed detection circuit 1715, and delay circuit 1718 to be described below.

FIGS. 4A to 4C are schematic diagrams for explaining the operation of the direction detection circuit 1713.

As shown in FIG. 4A, the direction detection circuit 1713 is a logic circuit for receiving A- and B-phase encoder signals output from the optical encoder 5049 and outputting a direction signal representing the moving direction of the carriage HC. As shown in FIG. 4B, the direction detection circuit 1713 monitors the intervals of pulse signals, i.e., the A- and B-phase encoder signals and detects whether the pulse interval is longer or shorter than the normal interval, thereby knowing reversal of the carriage moving direction.

The direction detection circuit 1713 executes the logic calculation shown in FIG. 4C to determine the direction. In this embodiment, when the direction signal is at low level, the carriage HC moves in the forward direction, and when the signal is at high level, the carriage HC is moving in the backward direction.

This circuit can be constituted by only an electrical logic circuit. However, this circuit operation can also be realized by causing the MPU 1701 to execute a processing program.

FIGS. 5A to 5C are schematic diagrams for explaining the operation of the position detection circuit 1714.

As shown in FIG. 5A, the position detection circuit 1714 is a pulse up/down counter for receiving one of the A- and B-phase encoder signals output from the optical encoder 5049 and the direction signal from the direction detection circuit 1713 and outputting a position signal representing the position of the carriage HC.

As shown in FIGS. 5B and 5C, this pulse up/down counter monitors whether the direction signal is at high or low level. If the direction signal is at low level, the pulses of the encoder pulse signal (A- or B-phase encoder signal) are counted and added. The position of the carriage HC is specified on the basis of the accumulated sum value. On the other hand, when the direction signal is at high level, the pulses (A- or B-phase encoder signal) are counted and subtracted from the accumulated value. The position of the carriage HC is specified on the basis of the subtraction result.

This circuit can be constituted by only an electrical logic circuit. However, this circuit operation can also be realized by causing the MPU 1701 to execute a processing program.

Figure 6A:
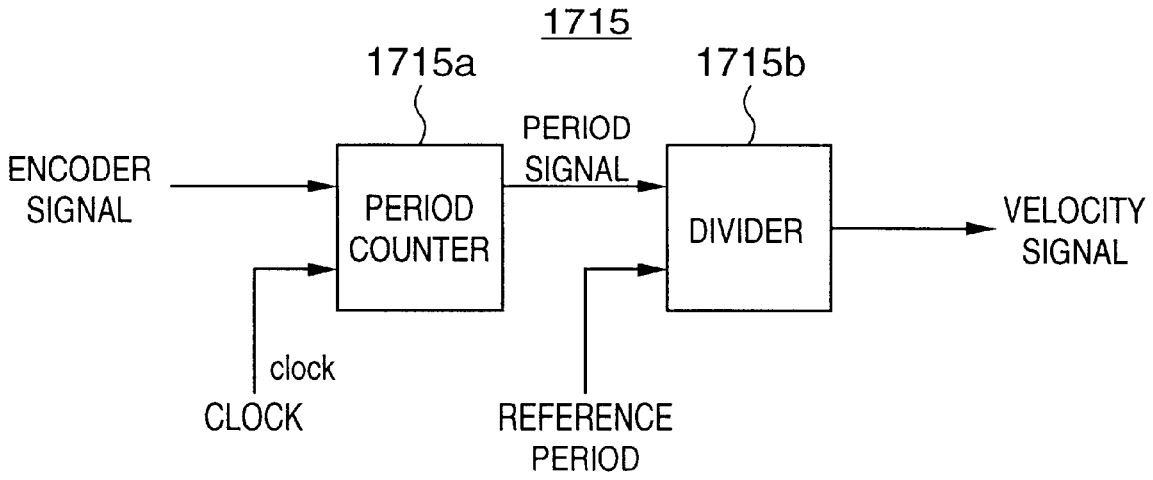
FIGS. 6A and 6B are schematic diagrams for explaining the operation of a speed detection circuit 1715.
Figure 6B:
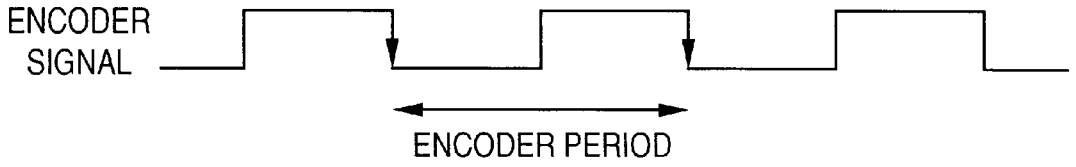

FIGS. 6A and 6B are schematic diagrams for explaining the operation of the speed detection circuit 1715.

As shown in FIG. 6A, the speed detection circuit 1715 comprises a period counter 1715*a* and a divider 1715*b*. The period counter 1715*a* receives the A- or B-phase encoder signal, as shown in FIG. 6B, output from the optical encoder 5049 and obtains the period (encoder period) of the encoder signal on the basis of a clock signal (CLOCK) supplied from the MPU 1701. This encoder period is output from the period counter 1715*a* as a period signal and input to the divider 1715*b*. The divider 1715*b* outputs a velocity signal representing the moving speed of carriage HC on the basis of the period signal and a reference period supplied from the MPU 1701.

This circuit can be constituted by only an electrical logic circuit. However, this circuit operation can also be realized by causing the MPU 1701 to execute a processing program.

Figure 7A:
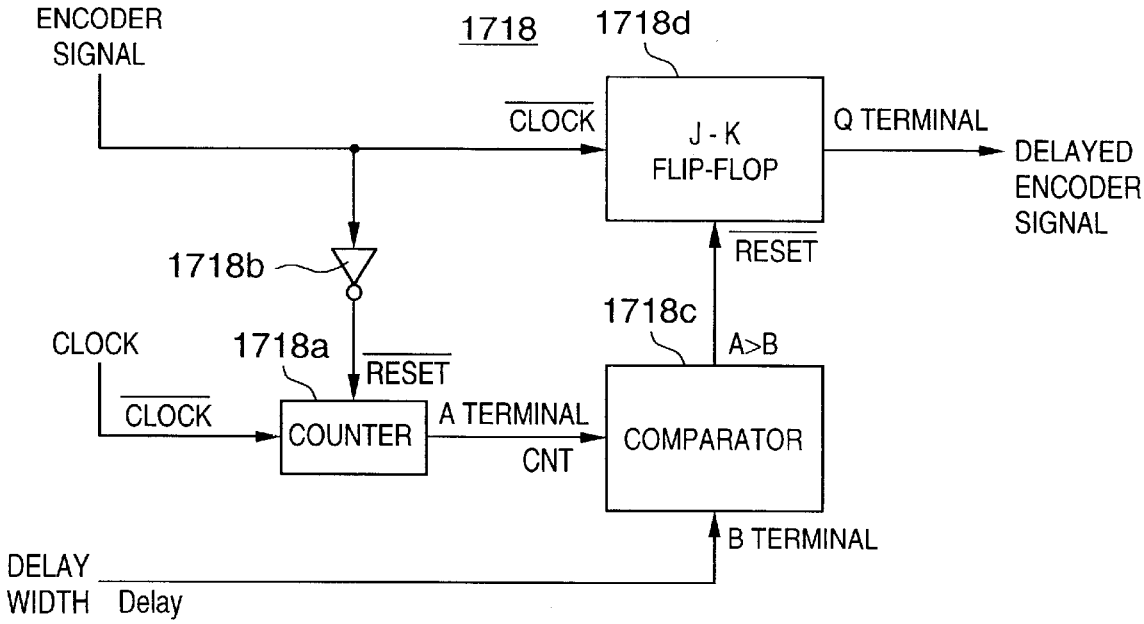
FIGS. 7A and 7B are schematic diagrams for explaining the operation of a delay circuit 1718.
Figure 7B:
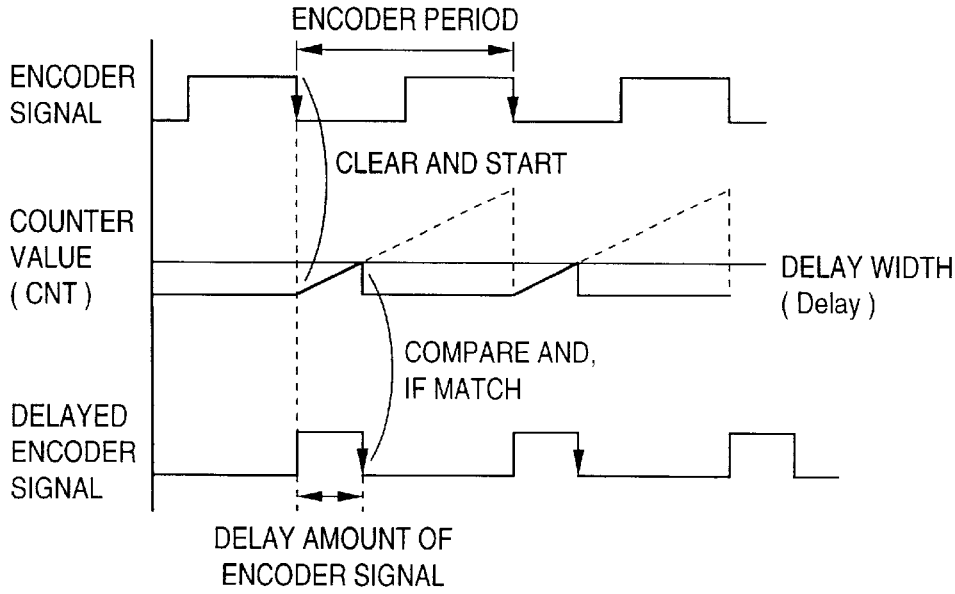

FIGS. 7A and 7B are schematic diagrams for explaining the operation of the delay circuit 1718.

As shown in FIG. 7A, the delay circuit 1718 comprises a counter 1718*a* for counting the pulses of the clock signal (CLOCK), an inverter 1718*b*, a comparator 1718*c*, and a J-K flip-flop 1718*d*.

A count value output from the counter 1718*a* is reset in response to a signal (RESET) obtained by inverting the A- or B-phase encoder signal by the inverter 1718*b*. The count value from the counter 1718*a* is input to the A terminal of the comparator 1718*c* and compared with a predetermined delay width (Delay) supplied from the MPU 1701 to the B terminal. The comparison result is input to the reset terminal of the J-K flip-flop 1718*d*.

An encoder signal is input to the J-K flip-flop 1718*d*. The encoder signal is delayed by the pulse width and output.

As shown in FIG. 7B, the encoder signal input to the J-K flip-flop 1718*d* is delayed by the pulse width and output from the Q terminal of the J-K flip-flop 1718*d*. The pulse width of the delayed encoder signal is adjusted to correspond to the time until the count value (CNT) output from the counter 1718*a* equals the delay value (Delay).

This circuit can be constituted by only an electrical logic circuit. However, this circuit operation can also be realized by causing the MPU 1701 to execute a processing program.

Figure 8A:
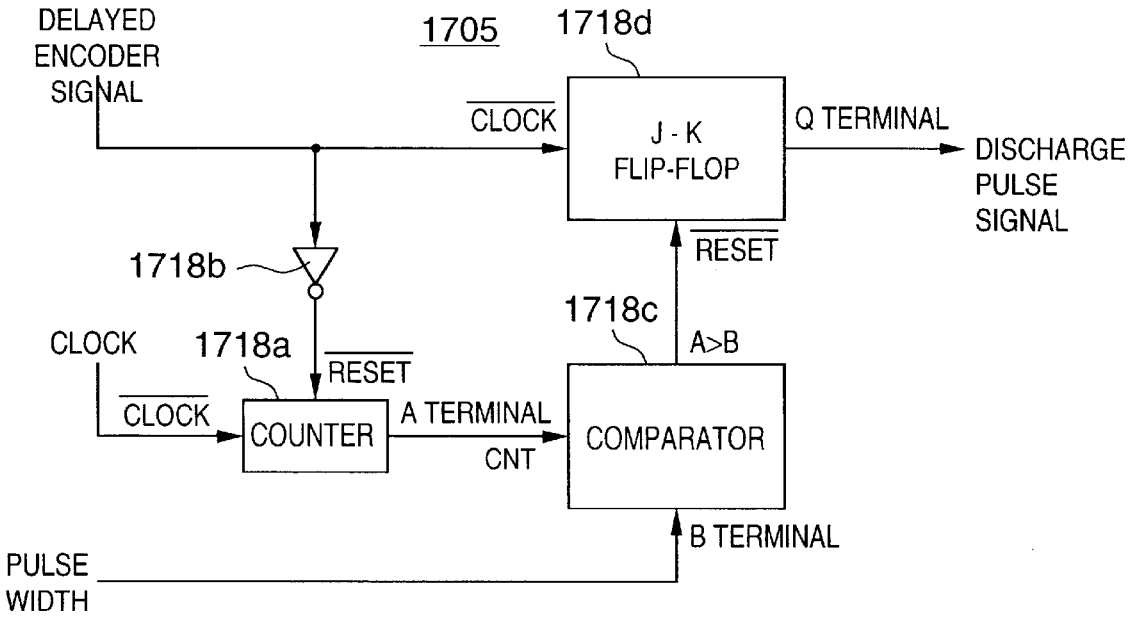
FIGS. 8A and 8B are schematic diagrams for explaining the operation of a head driver 1705.
Figure 8B:
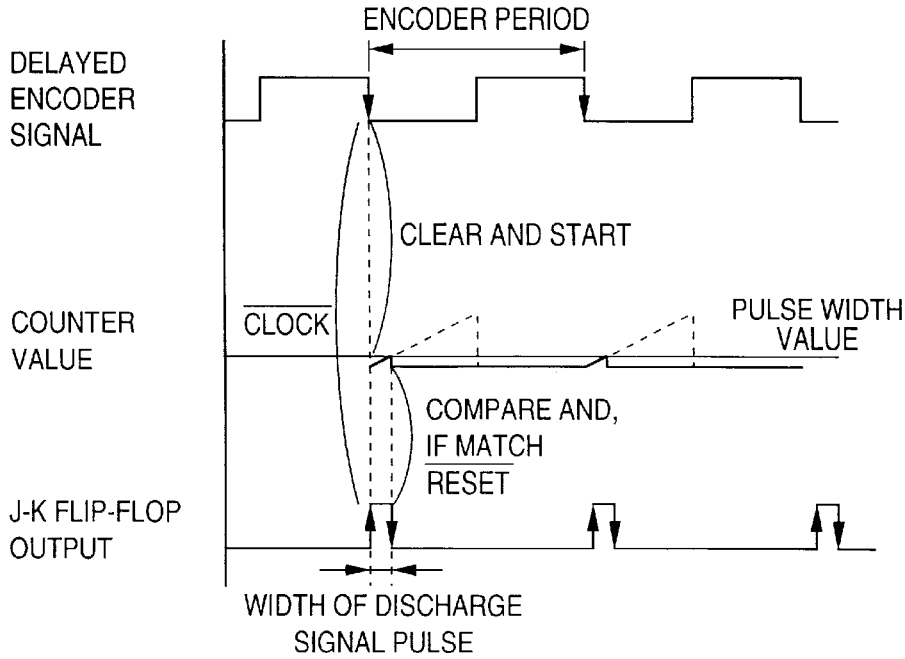

FIGS. 8A and 8B are schematic diagrams for explaining the operation of the head driver 1705. The head driver 1705 receives the delayed encoder signal and outputs a very short pulse having a width convenient for the printhead IJH to discharge ink.

As is apparent from comparison between FIG. 7A and FIG. 8A, the head driver 1705 has the same arrangement as that of the delay circuit 1718, and the same reference numerals denote the same constituent elements in these drawings. The head driver 1705 is different from the delay circuit 1718 in that the J-K flip-flop 1718*d* receives the delayed encoder signal, the B terminal of the comparator 1718*c* receives a signal pulse having a predetermined width, which is supplied from the MPU 1701, and the output signal from the Q terminal of the J-K flip-flop 1718*d* becomes an ink discharge signal pulse to be supplied to the printhead IJH.

As shown in FIG. 8B, the delayed encoder signal input to the J-K flip-flop 1718*d* is delayed by the pulse width and output from the Q terminal of the J-K flip-flop 1718*d*. The pulse width of the output signal (discharge signal pulse) is adjusted to correspond to the time until the count value (CNT) output from the counter 1718*a* equals the pulse width of the input pulse signal.

The head driver 1705 may operate upon directly receiving the encoder signal.

Figure 9:
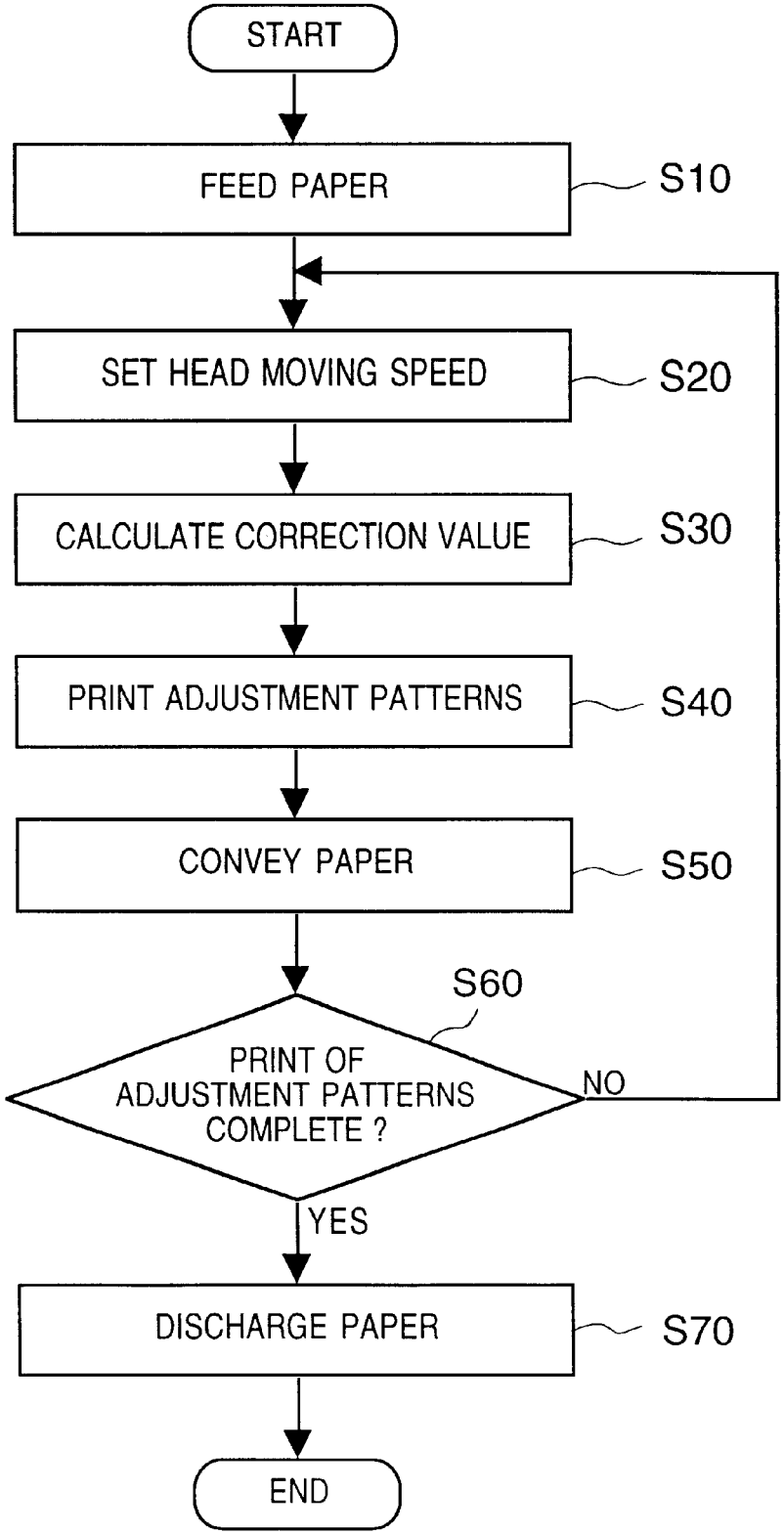
FIG. 9 is a flow chart showing part of bidirectional registration adjustment processing.
Figure 10:
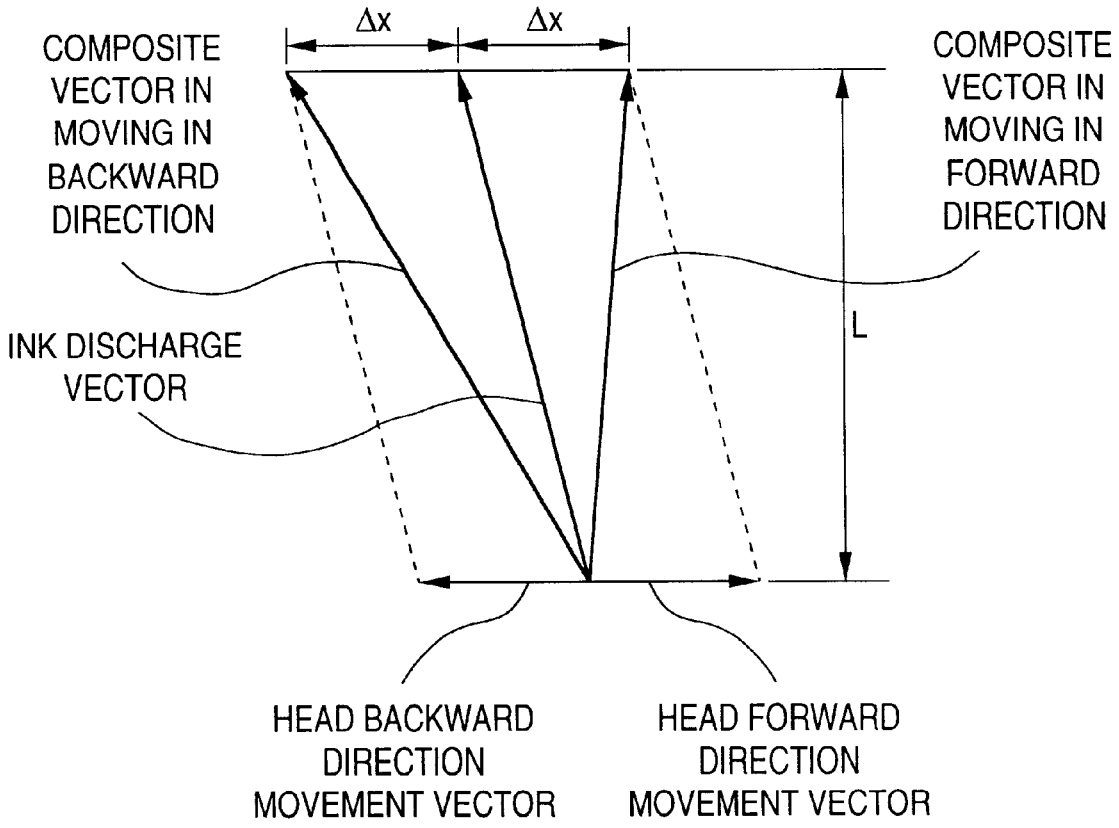
FIG. 10 is a view showing a printing position shift.

Bidirectional registration adjustment processing of the printer having the above arrangement will be described next with reference to the flow chart shown in FIG. 9.

Before this processing is executed, (1) design values associated with the ink discharge velocity ($V_{DROP}$), ink discharge angle (θ), distance (L) between the printhead and the printing medium surface, and printhead moving speed ($V_{CR}$), which must be taken into consideration in equation (1), are stored in the ROM 1702, and (2) a program that executes a calculation of equation (1) is stored in the ROM 1702.

On this assumption, the MPU 1701 reads out a bidirectional registration adjustment program from the ROM 1702 and executes the program. In this processing, when adjustment patterns are to be printed, the carriage moving speed ($V_{CR}$) which substantially influences the ink discharge velocity ($V_{DROP}$) can be changed.

This change is made, in executing the bidirectional registration adjustment program in cooperation with a host computer (hereinafter referred to as a host), by designating the carriage moving speed ($V_{CR}$) itself or designating a change amount in carriage moving speed ($V_{CR}$) from the previous value from the host.

In step S10, printing paper on which adjustment patterns are to be printed is fed. In step S20, a new carriage moving speed ($V_{CR}$) is set.

In step S30, the printing position shift amount is calculated from equation (1). In step S40, an adjustment pattern is printed on the basis of the calculated shift amount. After the pattern is printed, the printing paper is conveyed by a predetermined amount in step S50. In step S60, it is checked whether printing of adjustment patterns is complete.

If YES in step S60, the flow advances to step S70 to discharge the printing paper. If NO in step S60, the flow returns to step S20.

When the flow returns to step S20, the carriage moving speed ($V_{CR}$) is changed from the previously set value by a predetermined amount. This change in step S20 can be automatically performed on the basis of a value which is designated immediately before execution of the bidirectional registration adjustment program. Alternatively, the bidirectional registration adjustment program may inquire of the apparatus user about the change through the display screen (not shown) of the host every time step S20 is executed.

With the above processing, adjustment patterns corresponding to several carriage moving speeds ($V_{CR}$) are printed on the printing paper.

Subsequently, the apparatus user visually compares and checks the printed adjustment patterns, selects the best pattern (print result with highest quality) and stores the ink discharge velocity ($V_{DROP}$) corresponding to the selected adjustment pattern in the NVRAM 1708. This processing is executed by the apparatus user by inputting an instruction from the host to the printer using a keyboard or mouse of the host with reference to menus or icons displayed on the display screen of the host.

After this, the shift amount is calculated using the ink discharge velocity ($V_{DROP}$) stored in the NVRAM 1708, and printing is performed while correcting the printing position using the shift amount.

To shift the printing position, the printer of this embodiment has the linear encoder. The ink discharge position is controlled in units of output pulses from the encoder. For the interval between adjacent pulses, minute discharge position control is performed by the delay circuit.

According to the above-described embodiment, adjustment patterns can be printed while changing the carriage moving speed ($V_{CR}$) which substantially largely influences on the ink discharge velocity ($V_{DROP}$), and the ink discharge velocity ($V_{DROP}$) for the best correction can be selected from the print result. For this reason, even though the ink discharge velocity of the printhead largely varies, correction can be appropriately performed to print a high-quality image.

In the above-described embodiment, the processing program for calculating shift of the printing position, and the shift factors are stored in the ROM, and processing is performed using the MPU of the printer in cooperation with the host. However, the present invention is not limited to this. For example, shift calculation is done by another host, and the calculation is stored in a ROM in advance. In this case, the printer only needs to select the calculation result.

In the above-described embodiment, the processing program is executed by the MPU. However, the present invention is not limited to this. For example, only digital electrical circuits may be used, or a so-called DSP with enhanced calculation functions may be used.

Further, a droplet discharged from the printhead is explained as an ink droplet, and liquid stored in the ink tank is explained as ink in the above embodiment, however, the present invention is not limited to ink. For example, processed liquid to be discharged toward a printing medium for improving stability, water-resistance, and quality of an image may be stored in the ink tank.

The above-described embodiment has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type printing apparatus and a continuous type printing apparatus. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable. to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating maybe used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copying machine, facsimile machine). Furthermore, it goes without saying that the invention is applicable also to a case where the object of the present invention can be achieved by supplying a memory medium which stores program codes for realizing the functions of the aforesaid embodiment to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for supplying the program codes.

Furthermore, besides the aforesaid functions according to the above embodiments are realized by executing the program codes which are read by a computer, the present invention includes a case where an OS (operation system) or the like working on the computer performs a part of, or the entire process in accordance with designations of the program codes, and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPA or the like contained in the function expansion card or unit performs a part of, or the entire process in accordance with designations of the program codes and realizes functions of the above embodiments.

As many different embodiments of the present invention can be made without departing from the spirit and scope thereof, it is to be understood that the invention is not limited to the specific embodiments thereof, except as defined in the appended claims.

What is claimed is:

1. A correction method of correcting a printing position shift when printing on a printing medium is performed by discharging ink from a printhead while reciprocally scanning the printhead, comprising:

a test printing step, of test-printing a plurality of patterns, wherein the plurality of patterns are patterns printed by changing a printhead scanning speed;

a selection step, of selecting one of the plurality of printed patterns;

a storage step, of storing information, on an ink discharge velocity from the printhead used for test-printing the selected pattern after performing said selection step, into a memory; and a calculation step, of calculating a correction amount for correcting the printing position shift, based on the selected pattern, wherein said calculation step includes calculating the correction amount, based on the information stored in the memory, and said test-printing step includes test-printing by controlling ink discharge from the printhead according to the changed printhead scanning speed.

2. The method according to claim 1, wherein an operator makes a selection in said selection step.

3. The method according to claim 1, wherein the memory is a non-volatile memory.

4. The method according to claim 1, wherein the printing position shift is a shift ($\Delta X$) with respect to a scanning direction of the printhead.

5. The method according to claim 1, wherein said calculation step includes calculating the correction amount using an equation:

$$\Delta X=\{L/(V_{DROP})X \sin \theta)\}\times V_{CR}$$

where $V_{DROP}$ is the ink discharge velocity, $V_{CR}$ is the printhead scanning speed, L is a distance between the printhead and the printing medium, and θ is an ink discharge angle with respect to the printing medium.

6. The method according to claim 1, wherein said test printing step includes tentatively performing printing while changing the printhead scanning speed by a predetermined amount.

7. A printing apparatus, having scanning means for reciprocally scanning a printhead, for performing printing on a printing medium by discharging ink from said printhead while scanning said printhead by said scanning means, comprising:

test pattern printing means for test-printing a plurality of patterns, wherein the plurality of patterns are patterns printed by changing a printhead scanning speed;

selection means for selecting one of the plurality of patterns;

memory means for storing information on an ink discharge velocity from said printhead corresponding to a printhead scanning speed used for test-printing the pattern selected by said selection means;

calculation means for calculating a correction amount for correcting a printing position shift when printing on a printing medium is performed by discharging ink from said printhead, based on a pattern selected from the plurality of patterns by said selection means; and printing means for performing actual printing while performing correction based on the correction amount calculated by said calculation means, wherein said calculation means calculates the correction amount, based on the information stored by said memory means, and said test pattern printing means test-prints by controlling ink discharge from the printhead according to the changed printhead scanning speed.

8. The apparatus according to claim 7, further comprising scanning speed detection means for detecting a scanning speed during reciprocal scanning of said printhead, wherein said calculation means calculates the correction amount, based on the scanning speed detected by said scanning speed detection means and an ink discharge velocity from said printhead corresponding to a printhead scanning speed used for test-printing the pattern selected by said selection means.

9. The apparatus according to claim 8, further comprising position detection means for detecting a position of said printhead during the reciprocal scanning.

10. The apparatus according to claim 9, wherein said scanning speed detection means and said position detection means respectively detect the scanning speed and position of said printhead, based on an encoder signal obtained from a linear encoder placed along a scanning direction of said scanning means.

11. The apparatus according to claim 10, wherein said linear encoder includes one of an optical encoder and a magnetic encoder.

12. The apparatus according to claim 7, wherein said printhead comprises an inkjet printhead for discharging the ink to perform printing.

13. The apparatus according to claim 12, wherein said printhead comprises an electrothermal transducer for generating thermal energy to be applied to the ink, thereby discharging the ink using the thermal energy.

14. The apparatus according to claim 7, wherein said memory means comprises an EEPROM.

15. A computer program product executable in a computer for correcting a printing position shift when printing on a printing medium is performed by discharging ink from a printhead while reciprocally scanning the printhead, comprising:

a test printing process code for causing an inkjet printer to test-print a plurality of patterns, wherein the plurality of patterns are patterns printed by changing a printhead scanning speed;

a selection process code for selecting one of the plurality of printed patterns;

a storage process code for storing information on an ink discharge velocity from the printhead used for test-printing the selected pattern after performing said selection process into a memory; and a calculation process code for calculating a correction amount for correcting the printing potion shift, based on the selected pattern, wherein said calculation process calculates the correction amount, based on the information stored in the memory, and said test-printing process code causes test-printing to be performed by controlling ink discharge from the printhead according to the changed printhead scanning speed.

* * * * *